United States Patent [19]

Layton, Jr.

[11] 4,159,549

[45] Jul. 3, 1979

[54] CUSPIDOR

[76] Inventor: Guy V. Layton, Jr., 2230 4th St., Port Neches, Tex. 77651

[21] Appl. No.: 762,506

[22] Filed: Jan. 26, 1977

[51] Int. Cl.[2] ..... A61J 19/00

[52] U.S. Cl. ..... 4/285

[58] Field of Search ..... 4/110, 261, 275, 231, 4/258, 259, 274, 277, 285; 210/170, 470; 99/321, 322, 323; 128/2 F, 295; 220/90.4, 18, 63 R; D7/10, 70

[56] References Cited

U.S. PATENT DOCUMENTS

| | | | |
|---|---|---|---|
| 415,256 | 11/1889 | Swartwout | 4/261 |
| 936,888 | 10/1909 | Heim | 4/261 |
| 1,156,605 | 10/1915 | Lane | 4/285 |
| 1,913,806 | 6/1933 | High | 220/18 |
| 2,654,892 | 10/1953 | Szabo | 4/110 |
| 3,172,132 | 3/1965 | Mucha | 4/259 |

*Primary Examiner*—Lenard A. Footland
*Attorney, Agent, or Firm*—Jack W. Hayden

[57] ABSTRACT

A hollow member having a closed end and an open end is provided with a projection adjacent but spaced from one end thereof with a flange or laterally extending portion to enable the hollow member to be secured on a ledge such as a car door handle, ash tray or the like. A handle is secured to the member and an open end plastic bag or liner is positioned in the hollow member with a body of cellular material conforming with and contained therein.

1 Claim, 3 Drawing Figures

CUSPIDOR

SUMMARY OF THE INVENTION

The present invention relates to a cuspidor which may be manually carried or readily positioned on a car door handle, ash tray or the like as well as having a flat end for seating on a table top or other flat surface.

An object of the present invention is to provide a cuspidor which is portable and the contents of which may be easily and readily disposed of so that it can be reused a number of times and maintain a sanitary condition.

Another object of the present invention is to provide a hollow cylindrical member closed at one end with a plastic bag or liner therein and a mass of cellular absorbent material in the liner. After the cuspidor has served its purpose, the plastic bag or liner may be manually grasped at one end and removed from the hollow member and disposed of and then replaced with another liner and mass of cellular material for subsequent use of the cuspidor.

Another object of the present invention is to provide a hollow cylindrical member closed at one end with a plastic bag or liner therein and a mass of cellular absorbent material in the liner. After the cuspidor has served its purpose, the plastic bag or liner may be manually grapsed at one end and removed from the hollow member and disposed of and then replaced with another liner and mass of cellular material for subsequent use of the cuspidor. The hollow member is preferably cylindrical in configuration and is provided with an extension adjacent but spaced from its upper end, the extension having a flange or lateral projection depending therefrom to enable the hollow cylindrical member to be hung from a door handle, ash tray or any other suitable ledge. The hollow annular member also is provided with a handle to enable the hollow member to be carried about when desired.

Other objects and advantages of the present invention will become apparent from a consideration of the following description and drawings.

DESCRIPTION OF THE PREFERRED EMBODIMENT

Figure 1:
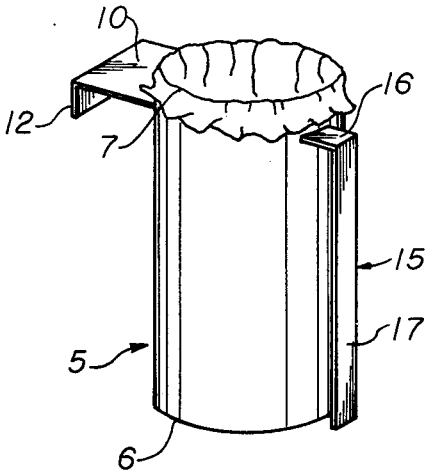
FIG. 1 is a perspective view illustrating the present invention assembled and ready for use.
Figure 2:
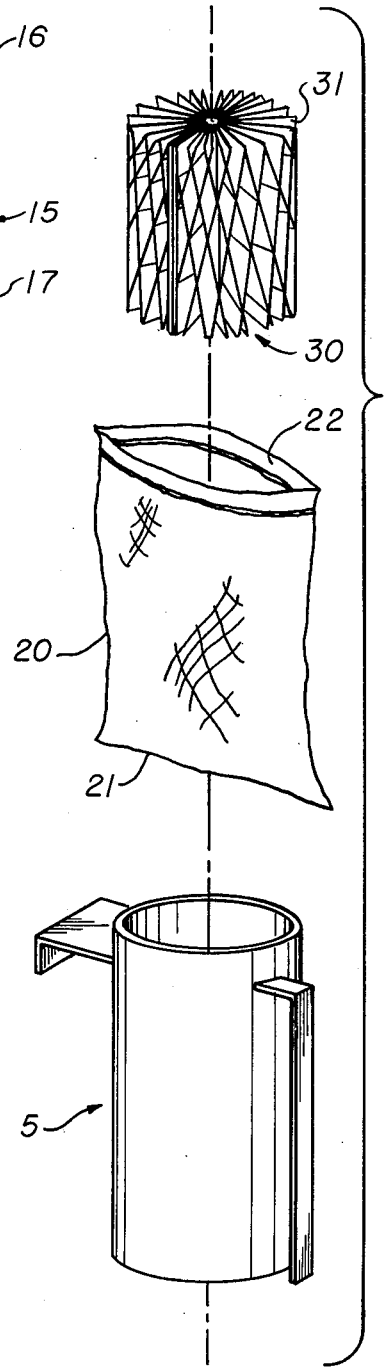
FIG. 2 is an exploded view illustrating the details of the present invention.

Attention is first directed to FIG. 1 of the drawings. When the cuspidor of the present invention is shown as including a hollow member referred to generally by the numeral 5. The hollow member is shown as being of cylindrical configuration and having a closed lower end 6 and an open upper end 7. A projection 10 extends laterally from the hollow member adjacent but spaced from preferably the upper open end 7 as shown in the drawings, such projection having a flange or lateral extension 12 depending therefrom whereby the hollow annular member may be supported on a ledge such as the door handle, ash tray or any other projection of a vehicle, or any other projection of a chair, table or the like.

The hollow member 5 also includes a handle referred to generally at 15 including the portion 16 that extends laterally from the hollow member 5 and an elongated extension 17 that extends longitudinally of the hollow member 5 as shown in the drawings.

A plastic bag or liner 20 is provided for fitting within and lining the hollow cylindrical member 5, the bag 20 having a closed end 21 and an open upper end 22. If desired the liner 20 may have an arrangement adjacent the open upper end 22 so that when it is grasped and the fingers moved along the open upper end 22, it seals or closes automatically.

The liner 22 is positioned within the hollow member 5 and its upper end may be folded down over the upper edge of the open end 7 as illustrated in the drawings.

A mass of cellular material 30 is adapted to be received within the liner, such mass of cellular material being of any suitable substance such as paper, or any other material which conforms to the configuration of the hollow annular member and is provided with a plurality of honeycomb type cells 31 that provide a substantial surface area in the cellular mass 30 for absorbing liquids orally placed in the cuspidor of the present invention.

Figure 3:
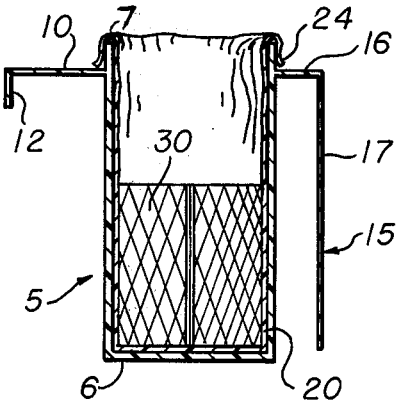
FIG. 3 is a section view illustrating the relationship of the components of the present invention when assembled.

As illustrated in FIG. 3 of the drawings, the mass of cellular material comprises about one-half of the total volume of the hollow annular member 5 and is preferably positioned adjacent the lower closed end 6 thereof when the cuspidor is initially placed in use.

Thereafter, the cuspidor of the present invention may be manually grasped by the handle 15, or it may be placed on a flat surface by reason of the end 6 of the hollow cylindrical member 5, or it may be hung from a table ledge or any other surface having a ledge by the arrangement of the projection 10 and depending portion 12.

After the cuspidor has served its purpose, it is only necessary to manually grasp the overhanging edge 24 of the liner or plastic bag 20 and to then close it in any suitable or desired manner and withdraw it and the mass of cellular material from the hollow member 5.

Thereafter, a new liner and new plastic mass may be positioned in the hollow member for use as previously described.

The foregoing disclosure and description of the invention are illustrative and explanatory thereof, and various changes in the size, shape, and materials as well as in the details of the illustrated construction may be made without departing from the spirit of the invention.

What is claimed is:

1. A cuspidor comprising:

a. a hollow cylindrical member having a lower closed end and an open upper end;

b. a lateral projection extending therefrom adjacent, but spaced from said open upper end of said member, said projection having a longitudinal extension on the end thereof;

c. handle means on said member comprising a lateral projection and a longitudinal extension;

d. a plastic liner for said member having one end closed and one end open, with the open end of said liner extending over said open end on said member, and having means for sealing said liner; and e. a cylindrical body of honeycomb type cellular paper material conforming with and contained in said hollow member with said body of cellular material being positioned adjacent said lower closed end of said member and filling approximately one-half of said hollow member.

* * * * *